US010892578B2

(12) United States Patent
Witte et al.

(10) Patent No.: US 10,892,578 B2
(45) Date of Patent: Jan. 12, 2021

(54) CONDUCTOR TERMINAL

(71) Applicant: WAGO Verwaltungsgesellschaft mbH, Minden (DE)

(72) Inventors: Thomas Witte, Porta Westfalica (DE); Muhammet Ali Tuerkekoele, Minden (DE); Joerg Tumoseit, Preussisch-Oldendorf (DE)

(73) Assignee: WAGO Verwaltungsgesellschaft mit beschraenkter Haftung, Minden (DE)

( * ) Notice: Subject to any disclaimer, the term of this patent is extended or adjusted under 35 U.S.C. 154(b) by 0 days.

(21) Appl. No.: 16/709,893

(22) Filed: Dec. 10, 2019

(65) Prior Publication Data

US 2020/0185852 A1 Jun. 11, 2020

(30) Foreign Application Priority Data

Dec. 11, 2018 (DE) ..... 10 2018 131 794

(51) Int. Cl.
*H01R 13/428* (2006.01)
*H01R 13/11* (2006.01)
*H01R 13/426* (2006.01)
*H01R 13/50* (2006.01)

(52) U.S. Cl.
CPC ..... *H01R 13/428* (2013.01); *H01R 13/11* (2013.01); *H01R 13/426* (2013.01); *H01R 13/50* (2013.01)

(58) Field of Classification Search
CPC .. H01R 4/4818; H01R 4/4827; H01R 4/4845; H01R 4/4836; H01R 13/428; H01R 13/11; H01R 13/426; H01R 13/50
USPC ..... 439/441, 835, 729
See application file for complete search history.

(56) References Cited

U.S. PATENT DOCUMENTS 5,810,625 A * 9/1998 Klein ..... H01R 4/4845 439/709
6,666,707 B2 * 12/2003 Moret Codina ..... H01R 4/4836 200/51.09
7,785,134 B2 * 8/2010 Dhandapani ..... H01R 4/4818 439/441
9,543,700 B2 * 1/2017 Kollmann ..... H01R 13/62905
9,761,964 B2 * 9/2017 Meyer ..... H01R 4/4818
9,825,402 B2 11/2017 Köllmann et al.
10,193,245 B2 1/2019 Lorenschat et al.
10,498,050 B1 * 12/2019 Liang ..... H01R 4/4836
(Continued)

FOREIGN PATENT DOCUMENTS

DE 202006013216 U 11/2006
DE 102010060252 A1 5/2012
(Continued)

*Primary Examiner* — Gary F Paumen
(74) *Attorney, Agent, or Firm* — Muncy, Geissler, Olds & Lowe, P.C.

(57) ABSTRACT

A conductor terminal is provided that includes at least one insulating housing, at least one contact insert, which is arranged at least predominantly within the insulating housing and which has at least one clamping spring, at least one actuating lever, by means of which the clamping spring can be deflected, wherein the actuating lever is pivotable at least from an open to a closed position and vice versa, wherein the insulating housing has as separate components at least a main housing part and a cover part, which can be positively fixed to the main housing part by means of at least a positive locking element.

14 Claims, 5 Drawing Sheets

(56) References Cited

U.S. PATENT DOCUMENTS

| | | | | |
|---|---|---|---|---|
| 2003/0066673 | A1* | 4/2003 | Doutaz | H01R 4/5008 174/652 |
| 2015/0044897 | A1* | 2/2015 | Wu | H01R 4/4836 439/352 |
| 2015/0303594 | A1* | 10/2015 | Stadler | H01R 4/4836 439/729 |
| 2017/0274751 | A1 | 9/2017 | Obrist et al. | |
| 2020/0176897 | A1* | 6/2020 | Ober-Woerder | H01R 4/4827 |

FOREIGN PATENT DOCUMENTS

| | | | |
|---|---|---|---|
| DE | 102014102517 | A1 | 8/2015 |
| DE | 102014114021 | A1 | 3/2016 |
| DE | 102014114026 | A1 | 3/2016 |
| DE | 202014011234 | U1 | 9/2018 |

* cited by examiner

C - C

CONDUCTOR TERMINAL

This nonprovisional application claims priority under 35 U.S.C. § 119(a) to German Patent Application No. 10 2018 131 794.8, which was filed in Germany on Dec. 11, 2018, and which is herein incorporated by reference.

BACKGROUND OF THE INVENTION

Field of the Invention

The present invention relates to a conductor terminal.

Description of the Background Art

Conductor terminals are used for clamping at least one electrical conductor to the contact insert by clamping by means of the clamping spring. Such a connection terminal is known for example from DE 10 2014 102 517 A1, which corresponds to U.S. Pat. No. 9,761,964, which is incorporated herein by reference. From DE 10 2010 060 252 B4, an electrical connection unit is known. From DE 20 2006 013 216 U1, a clamping device for an insulated conductor connection is known. Further conductor terminals are known from DE 20 2014 011 234 U1, which corresponds to U.S. Pat. No. 9,543,700, which is incorporated herein by reference, and DE 10 2014 114 021 A1, which corresponds to US 2017/0274751.

SUMMARY OF THE INVENTION

It is therefore an object of the present invention to further improve a conductor terminal, for example, in mechanical robustness.

This object is achieved in a conductor terminal according to an exemplary embodiment in that provided is at least one insulating material housing, at least one contact insert, which is arranged at least predominantly within the insulating housing and which has at least one clamping spring, at least one actuating lever designed as a component separate from the insulating housing, by means of which the clamping spring can be deflected, wherein the actuating lever is pivotable at least from an open to a closed position and vice versa, wherein the insulating housing has as separate components at least a main housing part and a cover part which can be positively fixed to the main housing part by means of at least one positive locking element, and wherein the actuating lever has at least one retaining edge and at least when the actuating lever is closed, the cover part is secured against disengaging from the main housing part by means of the at least one retaining edge.

This has the advantage that the actuating lever is included in the stiffening and stabilization of the mechanical structure of the conductor terminal, in particular of the insulating housing, and thus has an additional function other than the one for actuating the clamping spring, namely, to increase the mechanical stability of the conductor terminal. If a tensile force is applied to the cover part, for example by pulling from the outside on the electrical conductor clamped on the contact insert, then in the present invention the cover part can, in addition to other fixing elements such as the positive fixing by the positive locking element, be supported on the further fixation provided by the retaining edge of the actuating lever and transmit the forces onto other parts of the insulating housing. In this way, a disengaging or pulling out of the cover part from the main housing part can be effectively counteracted. As a result, the maximum allowable conductor pull-out forces of the conductor terminal can be increased.

The at least one positive locking element can serve for fixing the cover part to the main housing part. Such a positive locking element may be designed, for example, as a latching element, so that the cover part can be fixed by latching this positive locking element or latching element to the housing part. The at least one positive locking element can be an integral part of the cover part, for example by the at least one positive locking element being integrally formed with the cover part. The cover part may for example have a corresponding mating contour, which cooperates with the retaining edge to secure the cover part on the main housing part.

The contact insert can have at least at least one clamping spring. The clamping spring may have a contact leg, a spring bow adjoining the contact leg and a clamping leg adjoining the spring bow. The clamping leg can terminate at its free end in a clamping edge, which serves for clamping the electrical conductor. The contact leg is used for mechanical fastening and support of the clamping spring on at least part of the conductor terminal, for example on the actuating lever, on a bus bar and/or on the insulating housing. The contact insert may additionally comprise, for example, a bus bar which is coupled to the clamping spring. The bus bar may have a conductor contact area at which the electrical conductor to be clamped is pressed against the bus bar by means of the clamping spring. The clamping point is then formed between the clamping edge of the clamping leg and the conductor contact area of the bus bar.

As mentioned, the actuating lever can have at least one open and one closed position. In this respect, the open position of the actuating lever can correspond to an open clamping point; the closed position of the actuating lever can correspond to a closed clamping point. When the clamping point is closed, an electrical conductor is clamped by means of the clamping spring; when the clamping point is open, the electrical conductor can be removed from the clamping point or introduced into it substantially without any force.

For example, the main housing part may include a recess or an opening that may be utilized to arrange the contact insert in the main housing part. The cover part serves to at least largely close this recess or opening, for example, by being completely or partially inserted in the recess or opening and being fixed therein. In order to insert the electrical conductor to be clamped in the insulating housing, the insulating housing has a conductor insertion opening. The conductor insertion opening can be disposed on the main housing part or on the cover part. The cover part may, for example, have a conductor insertion channel adjoining the conductor insertion opening through which an electrical conductor can be selectively guided to the clamping point.

According to an example, it is provided that at least when the actuating lever is closed, the cover part can be protected against disengaging from the main housing part by the at least one retaining edge in that the at least one positive locking element of the cover part is encompassed by at least one retaining edge. In this way, the positive locking element, which already serves for fixing the cover part to the main housing part, is additionally used for the fixation between the actuating lever and the cover part. Accordingly, in this embodiment, the mentioned mating contour of the cover part can be realized by the at least one positive locking element, for example, by a fixing edge of the positive locking element acting as a counterpart to the retaining edge.

An electrical conductor can be fixed on the contact insert by spring force using the clamping spring, wherein a tensile force exerted on the electrical conductor outside the conductor terminal is transferable to the contact insert, and from there to the cover part, and from the cover part to the actuating lever. By virtue of the force chain formed in this way, the tensile force exerted on the electrical conductor can be effectively transmitted to the actuating lever and thus at least partially diverted from the cover part.

The tensile force exerted on the electrical conductor outside the conductor terminal can be transmitted from the actuating lever to the main housing part. In this way, the aforementioned force chain can be continued up to the main housing part, that is, to a location at which the actuating lever is in turn attached to and/or supported on the main housing part.

The actuating lever can have a spring actuating region, on which at least one spring actuating element is arranged for deflection of the clamping spring, and a manual grip region on which the actuating lever is to be operated manually, wherein the retaining edge is arranged in the manual grip region. In this way, the retaining edge can be arranged at a suitable position on the actuating lever, without the areas of the actuating lever that correspond to the actuating mechanism of the clamping spring being affected or possibly needing to be redesigned.

The actuating lever can have at its side facing the cover part at least one recess on which the retaining edge is arranged. In this way, the recess can be arranged with the retaining edge, so to speak, on the inside of the actuating lever and in particular on the inside of the manual actuating area. In this way, the fixation of the cover part by means of the actuating lever can be made to be particularly efficient. In addition, this fixation does not impede the manual operation of the actuating lever and the visual appearance of the conductor terminal. The recess may in particular be designed in the manner of a blind hole, that is, as a recess which does not completely penetrate the actuating lever or the manual actuating region.

In the closed state of the actuating lever, a portion of the positive locking element of the cover part protruding out of the main housing part can project into the recess. This way, a positive fixing between the retaining edge arranged in the recess and the positive locking element of the cover part can be realized in a simple manner.

Also, at least in the closed position, the actuating lever can be fixed in a latching manner to the main housing part. This can ensure that the actuating lever remains in the closed position in a defined manner even if the conductor terminal is subjected to, for example, vibration or similar external influences. The latching fixation of the actuating lever on the main housing part can be realized, for example, in that the main housing part has at least one housing latching element, which is designed to cooperate with at least one lever latching element arranged on the actuating lever. As a result, the actuating lever can be fixed in latching manner by the lever latching element cooperating with the housing latching element, at least in the closed position. Further, the cooperation of the lever latching element with the housing latching element can easily ensure the transmission of the tensile force applied to the electric conductor outside the conductor terminal from the actuating lever to the main housing part.

The lever locking element may be, for example, formed as one or two latching pins projecting laterally from the manual actuating region on opposite sides. The housing latching element can be designed as a latching recess in a side wall of the main housing part assigned to the respective lever latching element. The latching pins can then engage in the latching recesses of the main housing part.

The main housing part can have a resilient latching tongue which engages under the positive locking element of the cover part and engages behind it with a latching edge when the cover part is fastened to the main housing part. This allows for a reliable fixing of the cover part to the main housing part. Thus, for example, the main housing part on the side facing the actuating lever can have a latching tongue with an end-side latching hook projecting parallel toward the conductor insertion direction. In this case, the positive locking element of the cover part may be formed for example as a bow-shaped retaining tab that the latching tongue with its end-side latching hook engages under and behind. The latching edge is thus formed at the end-side latching hook.

Also, it can be provided that on the side facing away from the positive locking element, the cover part can have a further positive locking element, which is adapted for positive connection with a retaining element of the main housing part. In this way, the cover part can be positively connected to the main housing part at least at two spaced-apart locations.

The main housing part can have an upper side, on which the actuating lever protrudes from the main housing part at least in the open position, and a lower side opposite the upper side, wherein the main housing part has a plurality of vertical walls connecting the upper side with the lower side, wherein on at least one vertical wall, a lateral fixing element is arranged through which the cover part can be laterally fixed by positive engagement with the main housing part. As a result, additional positive fixing between the main housing part and the cover part is realized. This makes it possible, for example, to additionally stabilize the vertical walls and to safeguard against bending out or bending away.

For this purpose, a lateral fixing element associated with the lateral fixing element can be arranged on the cover part, with which the positive connection to the lateral fixing element is produced when the cover part is fastened to the main housing part. The positive connection may be formed, for example, as a latching connection. In this case, the lateral fixing element may be formed as a latching element, for example with a latching tongue with an end-side latching hook aligned parallel to the conductor insertion direction. Further realization possibilities for the lateral fixing element is forming it as a latching pin and/or with a dovetail geometry.

The vertical walls may be formed, for example, as side walls of the main housing part, that is to say as side walls which bound the main housing part to the outside. If the conductor terminal is designed as a multi-pole conductor terminal which has a plurality of separate conductor connection chambers, internal dividing walls may be formed by the insulating housing in addition to the side walls, by means of which further vertical walls are realized. Also, the mentioned lateral fixing elements can be realized on such dividing walls.

Also provided is a conductor terminal comprising: at least one insulating housing having at least one conductor insertion opening for introducing an electrical conductor into the insulating housing, at least one contact insert, which is arranged at least predominantly within the insulating housing and which has at least one clamping spring, at least one actuating lever, by means of which the clamping spring can be deflected, wherein the actuating lever is pivotable at least from an open to a closed position and vice versa, wherein the insulating housing has as separate components at least one main housing part and a cover part, which can be positively fixed to the main housing part by means of at least one positive locking element, and wherein the main housing part has an upper side, on which the actuating lever protrudes from the main housing part, and a lower side opposite the upper side, wherein the main housing part has a plurality of vertical walls connecting the upper side with the lower side, wherein on at least one vertical wall a lateral fixing element is arranged by means of which the cover part can be fixed laterally by positive engagement with the main housing part, characterized in that the cover part has at least one conductor insertion opening.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
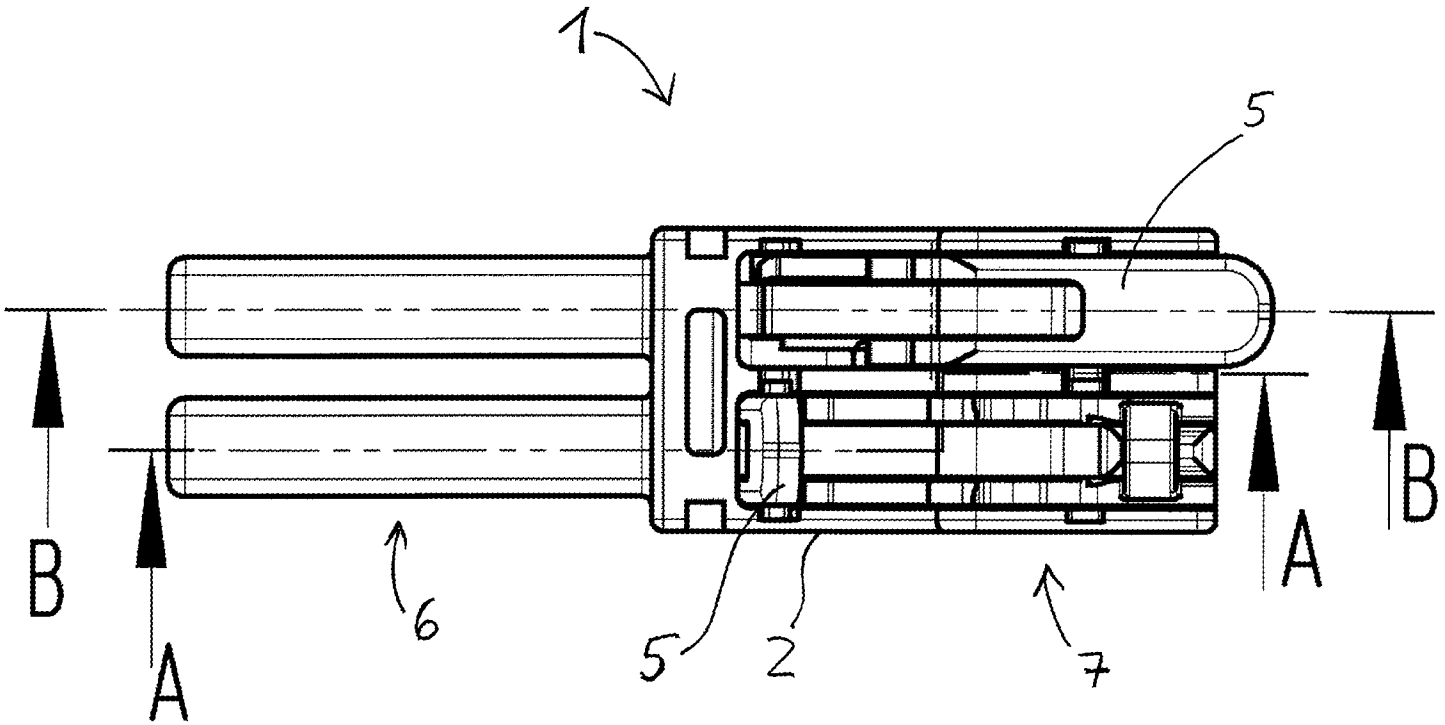
FIG. 1 shows a conductor terminal in a plan view.

FIG. 1 first shows the main components of the conductor terminal 1. The conductor terminal 1 is designed as a two-pole plug connector in the exemplary embodiment shown. For this purpose, the conductor terminal 1 has a connector region 6 and a conductor connection region 7. The conductor terminal 1 has an insulating housing 2 that extends over the connector region 6 and the conductor connection region 7. The conductor terminal 1 also has in each case an actuating lever 5 for each of the two contact inserts (as discussed below) arranged in the insulating housing 2. The actuating lever 5 is shown in the upper region of FIG. 1 in the closed position; in the lower region, in the open position. In FIG. 1, two section lines A-A and B-B are also drawn in, by means of which the internal structure of the conductor terminal 1 will be explained using FIGS. 2 and 3. The conductor terminal 1 has the same structure in both areas, i.e., in the area of section line B-B and section line A-A, so that the explanations apply to both areas. It should be noted that the section line A-A has a vertical offset approximately in the middle of the conductor connection region 7; thus, section line A-A does not reflect a continuous sectional plane.

Figure 2:
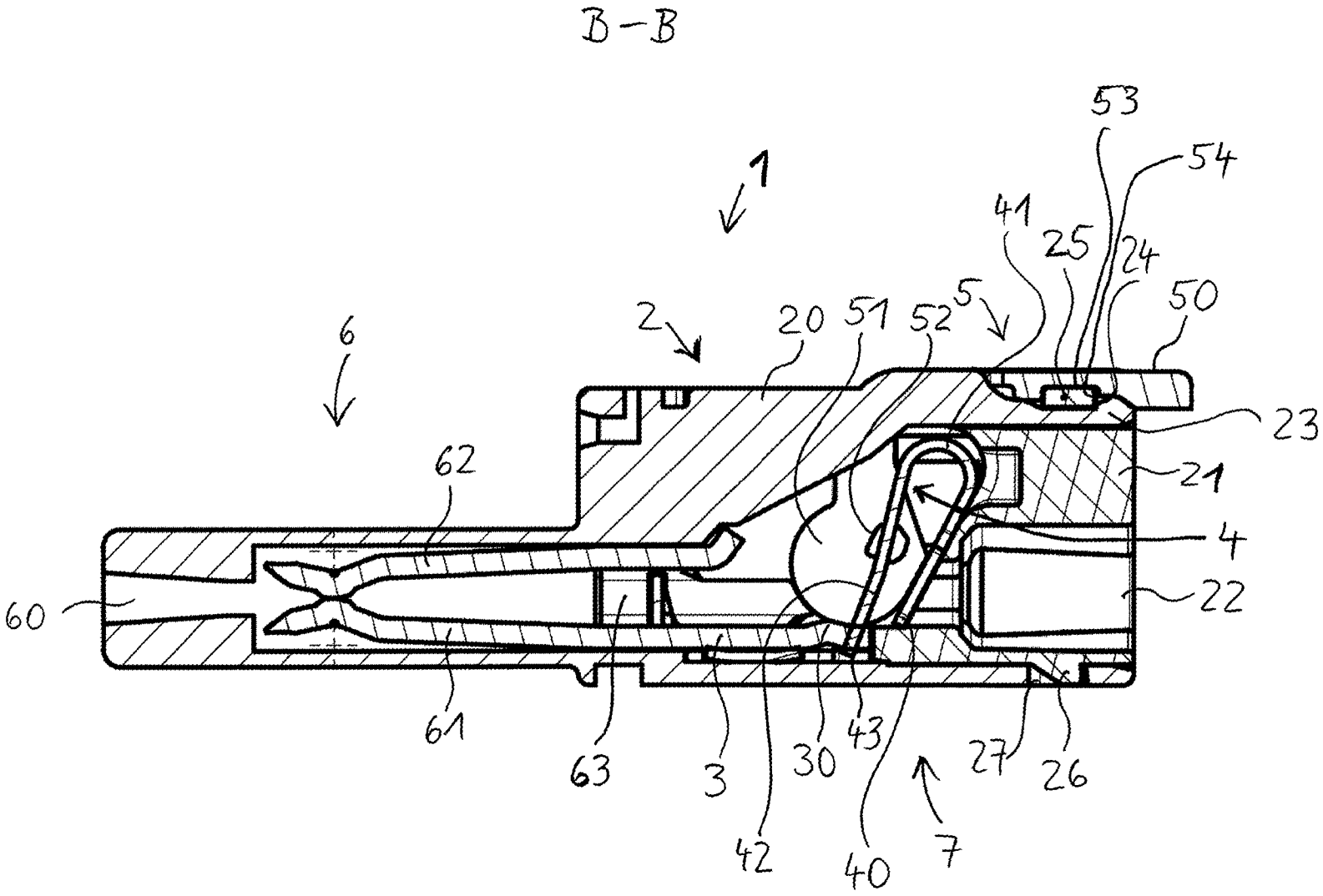
FIG. 2 shows the conductor terminal according to FIG. 1 in the cutting plane B-B indicated there.

FIG. 2 shows the section corresponding to section line B-B. This clearly shows that the insulating housing 2 is formed at least in two parts, with a main housing part 20 and a cover part 21, which is inserted into a recess of the main housing part 20 and is positively fixed therein. In the interior of the insulating housing 2, a contact insert having a clamping spring 4 and a bus bar 3 is disposed in the conductor connection region 7. The clamping spring 4 has a contact leg 40, a spring bow 41 adjoining the contact leg 40 and a clamping leg 42 adjoining the spring bow 41. The clamping leg 42 has at its free end a clamping edge 43. The bus bar 3 comprises a conductor connection region 30 in which, for example, a bead can be formed. An electrical conductor can be clamped at a clamping point formed between the clamping edge 43 and the conductor connection region 30. The electrical conductor can be inserted through a conductor insertion opening 22 into the insulating housing 2. The conductor insertion opening 22 may be arranged in the cover part 21.

In the connector region 6, the conductor terminal 1 has a plug contact which in this embodiment is formed as a socket contact designed as a fork contact with opposing contact legs 61, 62. The contact forks 61, 62 are connected to each other via a vertically extending connecting portion 63. The bus bar 3 may be integrally formed as a metal part with the contact legs 61, 62 and the connecting portion 63. At the end of the connector region 6, the insulating housing 2 has a plug contact insertion opening 60. Through this plug contact insertion opening 60, a contact pin or a contact blade can be inserted and clamped between the contact legs 61, 62. In the alternative, the arrangement of socket contact and contact pin or contact blade can also be provided reversed.

The conductor terminal 1 also has an actuating lever 5, which serves to actuate the clamping leg 42 of the clamping spring 4. For this purpose, the actuating lever 5 has spring actuating elements 52, which may be formed, e.g., as actuating cams arranged on the side faces 51 of the actuating lever 5. If the actuating lever 5 is pivoted from the closed position shown in FIG. 2 to the open position, the clamping leg 42 is entrained by means of the spring actuating elements 52 and in this case, in particular, moved away by the bus bar 3 so that the clamping point is opened.

The actuating lever 5 extends from the side faces 51 onward to a manual gripping portion 50 at which the actuating lever 5 can be manually operated. As can be seen, the manual gripping portion 50 may protrude beyond the outer contour of the insulating housing 2, so that it can be easily grasped even in the closed position and moved away from the closed position.

The cover part 21 is positively fixed to the main housing part 20. For this purpose, the cover part 21 has a positive locking element 25, which a latching tongue 23 of the main housing part 20 engages under and behind. The latching tongue 23 in particular has a latching edge 24, which engages behind the positive locking element 25. On the opposite side, the cover part 21 has a further positive locking element 26, for example a latching lug, with which the cover part 21 is also positively connected to the main housing part 20, namely, a retaining element 27 of the main housing part 20. The retaining element 27 may be formed, for example, as a latching recess.

Additional mechanical fixing of the cover part 21 is realized in that the actuating lever 5 has a retaining edge 54, for example, a retaining edge 54 arranged on the manual gripping portion 50, which cooperates with the positive locking element 25 of the cover part 21 and engages behind the latter at least in the closed position of the actuating lever 5.

Figure 3:
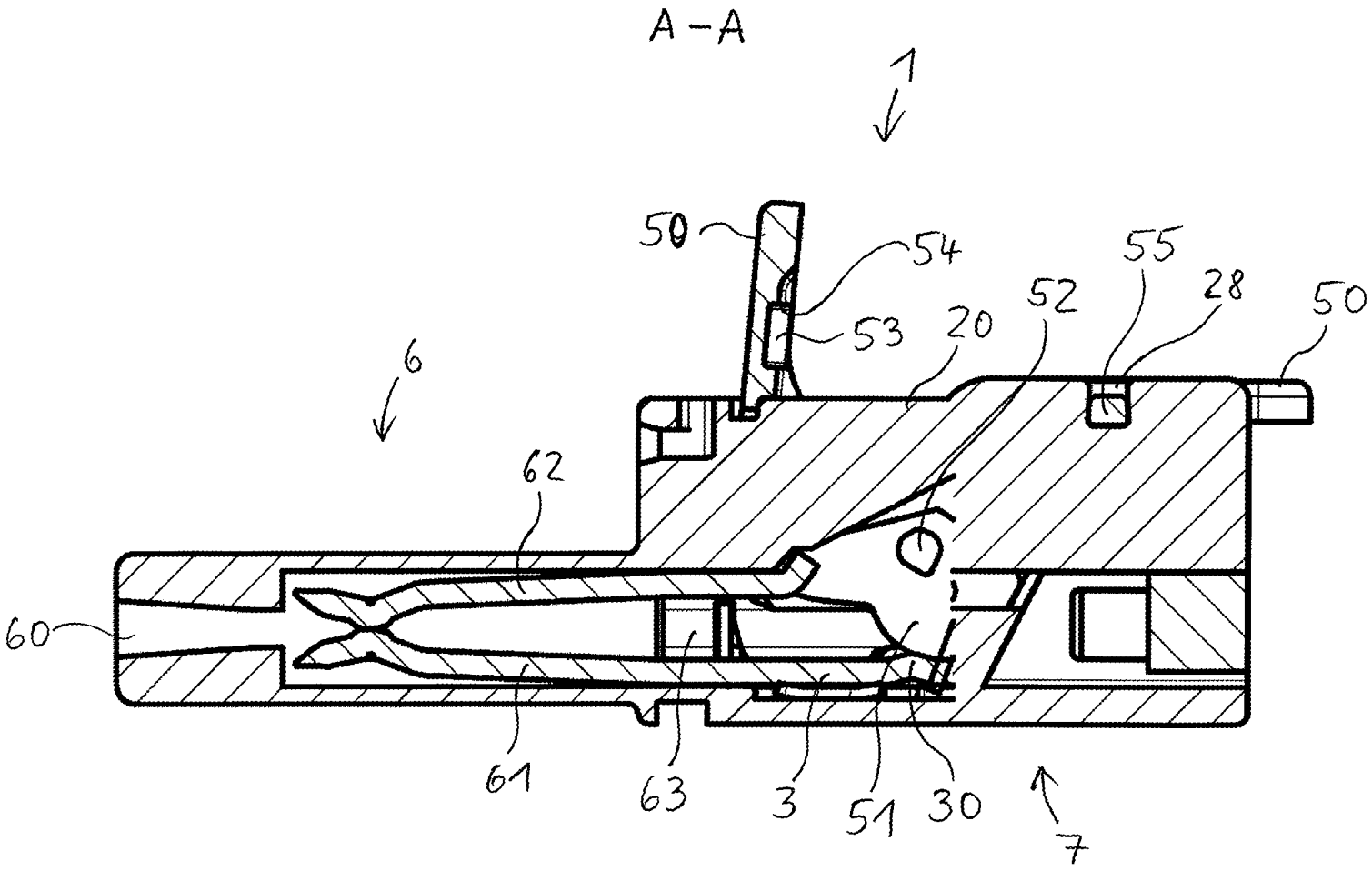
FIG. 3 shows the conductor terminal according to FIG. 1 in the cutting plane A-A indicated there.

FIG. 3 shows the conductor terminal 1 in the section line A-A. In this view, both actuating levers 5 shown in FIG. 1 can be seen, i.e., the one actuating lever arranged in the closed position and the other actuating lever shown in the open position. This in particular clarifies that the actuating lever 5 may have a blind hole-like recess 53 on the lower side on which the retaining edge 54 is formed.

FIG. 3 shows a further fixing of the actuating lever 5 on the insulating housing 2, in particular on the main housing part 21. In particular on the manual gripping portion 50, the actuating lever 5 may have laterally projecting lever latching elements 55, for example in the form of latching pins, on one or both sides. These lever latching elements 55 can cooperate with housing latching elements which are formed on the main housing part 20 for a latching fixation of the actuating lever 5. The housing latching elements 28, for example, may be formed as latching recesses. Accordingly, the latching pins can engage in the latching recesses of the main housing part 20 when the actuating lever 5 is in the closed position.

Figure 4:
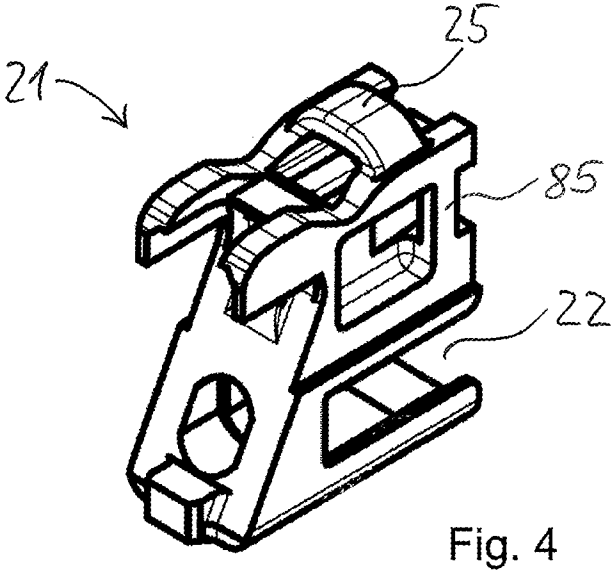
FIG. 4 shows a cover part in a perspective view.

FIG. 4 shows the cover part 21 in a perspective view. In particular, the bracket-like or bridge-like shape of the positive locking element 25 can be seen. Below the positive locking element 25 there is a free space through which the latching tongue 23 can be inserted into the main housing part 20.

Figure 5:
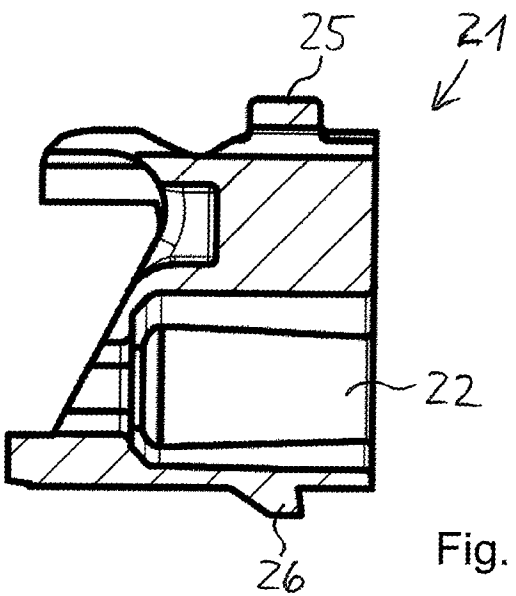
FIG. 5 shows the cover part according to FIG. 4 in a side sectional view.
Figure 7:
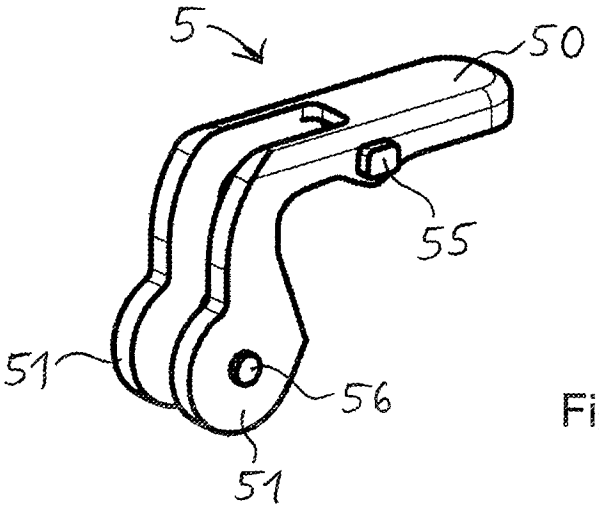
FIG. 7 shows the actuating lever according to FIG. 6 in a perspective view.

FIG. 5 additionally shows the cover part 21 in a side sectional view.

Figure 6:
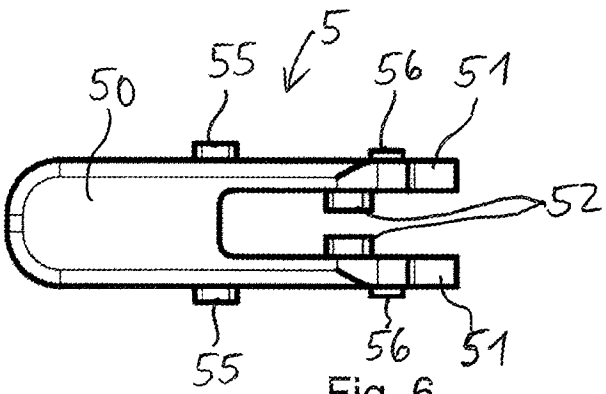
FIG. 6 shows an actuating lever in a plan view.

As becomes clear from FIG. 6, the lever latching elements 55 can be arranged on both sides of the manual gripping portion 50.

It can also be seen that the spring actuating elements 52 project to the inside of the side faces 51, i.e., to the area surrounded by the side faces 51. Alternatively, the two spring actuating elements 52 may also be connected to a continuous single spring actuating element. In addition to the defined support and swivel guide, the actuating lever 5 may have laterally projecting bearing pins 56. These bearing pins 56 can engage in corresponding bearing holes of the main housing part 20. Alternatively, the actuating lever 5 may also be floatingly mounted in the insulating housing 2. In this case, the bearing pins 56 are not required.

Figure 8:
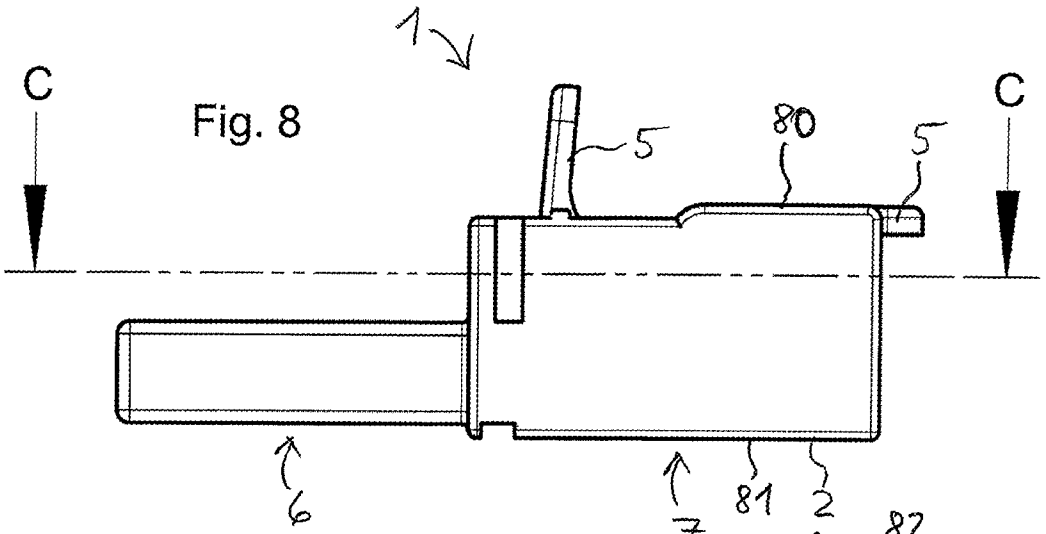
FIG. 8 shows the conductor terminal according to FIG. 1 in a side view.
Figure 10:
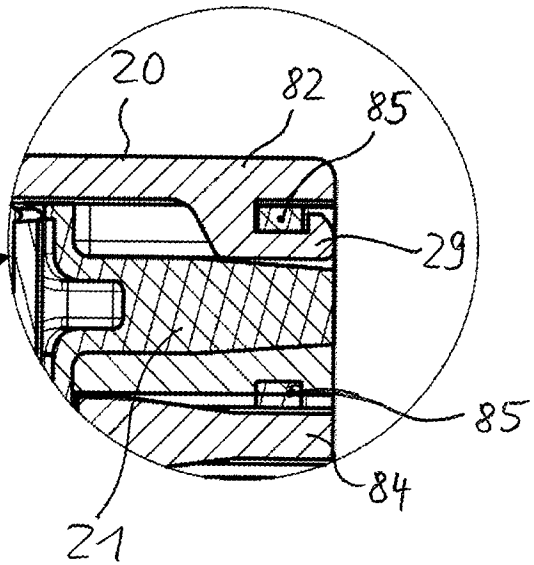
FIG. 10 shows an enlarged section of FIG. 9.
Figure 9:
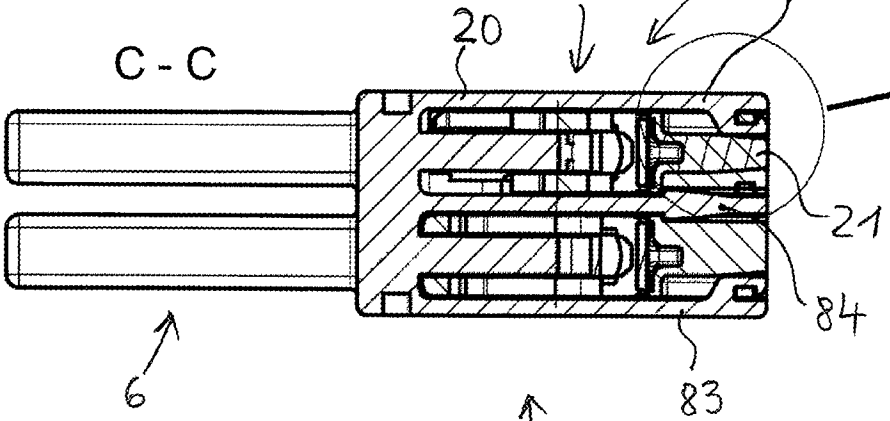
FIG. 9 shows the conductor terminal according to FIG. 8 in the cutting plane C-C indicated there.

As is illustrated by FIGS. 8 to 10, a further positive coupling between the cover part 21 and the main housing part 20 can be realized by lateral fixing elements 29. It is first assumed that the main housing part has an upper side 80, a lower side 81 opposite the upper side 80 and a plurality of vertical walls 82, 83, 84 connecting the upper side 80 to the lower side 81. In this case, the vertical walls 82, 83 may be formed as side walls which laterally bound the insulating housing 2 to the outside. In the interior of the insulating housing 2, at least one dividing wall may be present as a further vertical wall 84. At one or more of these vertical walls 82, 83, 84, in each case one or more lateral fixing elements 29 can be disposed in the manner seen in the enlarged detail of FIG. 10. The lateral fixing elements 29 may be positively connected to respective lateral positive locking elements 85 of the cover part 21. In this way, in particular a bending open or bending of a vertical wall 82, 83, 84 can be prevented.

Such a lateral fixing element 29 may be formed, for example, as a latching element, for example, with a latching tongue and an end-side latching hook, as is clarified in particular by FIG. 10. Such a latching element may then engage behind an associated lateral positive locking element 85.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

at least one insulating housing;

at least one contact insert that is arranged within the insulating housing and has at least one clamping spring;

at least one actuating lever designed as a separate component from the insulating housing, via which the clamping spring is adapted to be deflected, the at least one actuating lever being pivotable at least from an open to a closed position and vice versa, wherein the insulating housing comprises at least a main housing part and a cover part that is positively fixed to the main housing part via at least one positive locking element, wherein the actuating lever has at least one retaining edge, and wherein the cover part is secured against disengagement from the main housing part via the at least one retaining edge at least when the actuating lever is closed.

2. The conductor terminal according to claim 1, wherein the at least one positive locking element of the cover part is overlapped or encompassed by the at least one retaining edge.

3. The conductor terminal according to claim 1, wherein an electrical conductor is adapted to be fixed by spring force on the contact insert by the clamping spring, wherein a tensile force applied to the electrical conductor outside of the conductor terminal is transferable to the contact insert and from there to the cover part and from the cover part to the actuating lever.

4. The conductor terminal according to claim 3, wherein the tensile force exerted on the electrical conductor outside of the conductor terminal is transferable from the actuating lever to the main housing part.

5. The conductor terminal according to claim 1, wherein the actuating lever has a spring actuating region on which at least one spring actuating element for the deflection of the clamping spring is arranged, and a manual gripping portion in which the actuating lever is to be operated manually, wherein the retaining edge is arranged in the manual gripping portion.

6. The conductor terminal according to claim 1, wherein on its side facing the cover part, the actuating lever has at least one recess at which the retaining edge is disposed.

7. The conductor terminal according to claim 6, wherein a region of the positive locking element of the cover part projecting from the main housing part projects into the recess in a closed state of the actuating lever.

8. The conductor terminal according to claim 1, wherein at least in a closed position, the actuating lever is fixed in a latching manner on the main housing part.

9. The conductor terminal according to claim 8, wherein in the closed position of the actuating lever, at least one lever latching element projecting from the actuating lever cooperates with a housing latching element formed on the main housing part.

10. The conductor terminal according to claim 9, wherein the housing latching element is designed as a latching recess, in which in the closed position of the actuating lever the lever latching element designed as a latching pin engages.

11. The conductor terminal according to claim 1, wherein the main housing part has a resilient latching tongue that engages under the positive locking element of the cover part and engages behind the cover part with a latching edge when the cover part is fastened to the main housing part.

12. The conductor terminal according to claim 1, wherein on a side facing away from the positive locking element, the cover part has another positive locking element that is configured for positive connection with a retaining element of the main housing part.

13. The conductor terminal according to claim 1, wherein the main housing part has an upper side on which the actuating lever protrudes from the main housing part at least in an open position and a lower side opposite the upper side, wherein the main housing part has a plurality of vertical walls connecting the upper side with the lower side, wherein a lateral fixing element is arranged on at least one vertical wall by means of which the cover part is laterally fixed by positive engagement to the main housing part.

14. A conductor terminal comprising:

at least one insulating housing having at least one conductor insertion opening for inserting an electrical conductor in the insulating housing;

at least one contact insert, which is arranged at least within the insulating housing and which has at least one clamping spring; and at least one actuating lever via which the clamping spring is deflected, the actuating lever being pivotable at least from an open to a closed position and vice versa, wherein the insulating housing has at least one main housing part and a cover part that is positively fixed to the main housing part by at least one positive locking element, wherein the main housing part has an upper side on which the actuating lever projects out of the main housing part at least in the open position, and a lower side opposite the upper side, wherein the main housing part has a plurality of vertical walls connecting the upper side with the lower side, wherein a lateral fixing element is arranged at least on one vertical wall, via which the cover part is laterally fixed to the main housing part by positive engagement, and wherein the cover part has the at least one conductor insertion opening.

* * * * *